United States Patent [19]

Kowal

[11] Patent Number: 4,936,807

[45] Date of Patent: Jun. 26, 1990

[54] METHOD OF ASSEMBLING AN ELECTRIC LAMP HAVING A CANTED ARC TUBE

[75] Inventor: Albert E. Kowal, Corning, N.Y.

[73] Assignee: North American Philips Corporation, New York, N.Y.

[21] Appl. No.: 312,504

[22] Filed: Feb. 17, 1989

[51] Int. Cl.[5] ..... H01J 9/26

[52] U.S. Cl. ..... 445/22; 445/2; 445/26

[58] Field of Search ..... 445/2, 22, 26

[56] References Cited

U.S. PATENT DOCUMENTS

| | | | |
|---|---|---|---|
| 1,202,136 | 10/1916 | Wilkins | 445/2 |
| 2,116,129 | 5/1938 | Stringer | 445/2 X |
| 4,142,122 | 2/1979 | Koza | 445/26 X |

*Primary Examiner*—Kenneth J. Ramsey

*Attorney, Agent, or Firm*—Brian J. Wieghaus

[57] ABSTRACT

The invention is a method of assembling an electric lamp having a canted arc tube. The invention permits the lamp to be assembled using a standard bulged tube outer envelope having an elongate neck portion of the type normally used for lamps in which the arc tube is mounted coaxially with the envelope axis.

In the inventive method, a stem assembly having a pair of rigid conductors extending therefrom is first sealed in the open end of the neck portion in a gas-tight manner. The envelope is severed around its circumference in the region where the neck portion merges into the bulbous portion of the envelope. After the two portions are separated, a frame holding the arc tube is welded to the rigid inductors of the stem assembly with the arc tube positioned at the desired angle with respect to the lamp defined by the elongate neck portion. The two envelope portions are then resealed in a gas-tight manner and a lamp cap secured to the neck portion.

12 Claims, 5 Drawing Sheets

METHOD OF ASSEMBLING AN ELECTRIC LAMP HAVING A CANTED ARC TUBE

BACKGROUND OF THE INVENTION

1. Field of the Invention

The invention is an improved method of assembling electric lamps. More specifically, the invention relates to a method of manufacturing high intensity discharge (HID) lamps in which a discharge vessel, such as an arc tube, and frame assembly, when mounted on the lamp stem assembly, are not insertable through the neck portion of an outer envelope.

In the majority of HID lamps, the discharge vessel is arranged in an outer envelope aligned with the lamp axis. The outer envelope has a bulbous portion surrounding the arc tube, and an elongate neck portion extending from the bulbous portion. The arc tube is normally supported in the lamp envelope by a support frame fixed to rigid current-supply conductors extending from the lamp stem through the neck portion.

2. Description of the Prior Art

In manufacturing lamps of this type, a stem assembly is provided which comprises a stem press having a flared skirt, an exhaust tube, and a pair of rigid current-supply conductors extending from the stem press. A discharge device such as an arc tube is then mechanically fixed to the stem assembly by forming a frame including the rigid current-supply conductors, and then attaching the arc tube to the frame. The arc tube is electrically connected to the current-supply conductors either by the mechanical fixation or by auxiliary conductors. The arc tube and frame affixed to the current-supply conductors of the stem assembly are inserted into the bulbous portion of the outer envelope through the open end of the neck portion and aligned with the lamp axis. With the arc tube properly aligned, the flared skirt of the stem press is sealed in a gas-tight manner to the open end of the neck portion.

In certain lamp applications having elongated arcs, it is desirable to have the arc tube oriented at a certain angle with respect to a surface to increase the lighting of that surface. For example, more light will be cast on a playing field if the arc tube is in a horizontal plane than in a vertical plane. However, because existing luminaires at a specific location may be fixed in a predetermined position, it has not been possible to position a standard discharge lamp with the arc tube at the preferred angle with respect to the surface to be illuminated. For example, in sports stadiums the existing luminaires may be fixed at a predetermined position with respect to the playing field or are moveable to only a small degree. Alternatively, mechanical constraints on portable and extendable luminaires, for example in portable light towers for lighting sports fields, may limit the angle at which the luminaire can be supported. As a result, prior art lamps do not provide optimum light distribution when such luminaires are used.

A proposed solution to this problem has been to provide a lamp in which the discharge vessel, such as an arc tube, is supported in the outer envelope at a predetermined angle with respect to the lamp axis. The angle of the arc tube would be chosen such that when the lamp is mounted in a luminaire described above, the arc tube will be at the preferred angle with respect to the surface to be illuminated.

However, in lamps having an arc tube canted more than only a few degrees from the lamp axis, the configuration of the frame for supporting the arc tube has prevented the insertion of the frame and arc tube through the elongate neck portion of the outer envelope. Thus, the known assembly method described above in which the arc tube and frame are secured to the stem assembly prior to insertion into the outer envelope cannot be used. The same problem would occur if it were desired to insert a discharge vessel having a larger diameter than the neck portion of the outer envelope.

SUMMARY OF THE INVENTION

It is an object of the invention to provide a method of manufacturing a lamp having a support frame supporting an elongated discharge vessel at an angle with respect to the lamp axis, even though the discharge device and support frame, when mounted on the lamp stem assembly, are not insertable through the neck portion of the outer envelope during lamp assembly.

It is another object to provide a method which utilizes a standard outer lamp envelope, and a standard stem assembly.

Yet another object of the invention is to provide an assembly method in which a frame for holding the discharge vessel at a desired angle may be manufactured and fixed to the discharge vessel independently of the stem assembly.

It is still another object of the invention to provide a method which adds a minimal number of additional manufacturing steps and which uses conventional glass working techniques.

It is a further object of the invention to assemble the lamp without adversely affecting the light transmission through the bulbous portion of the outer envelope or its aesthetic appearance.

The objects of the invention are achieved by providing a stem assembly formed in a conventional manner, having a stem press and a rigid support fixed to the stem press for supporting the discharge vessel. The stem assembly is sealed to the neck portion of a standard bulged tube outer envelope in a conventional manner, before the discharge device is secured to the rigid support.

The outer envelope is then severed around its circumference in an axial region of the envelope where the rigid support terminates, preferably adjacent the base end of the bulbous portion. The severed bulbous portion not having the neck portion is then separated from the base end portion having the neck portion.

With the severed portions separated, the discharge vessel or arc tube is mechanically fixed at the preferred angle to the rigid support extending from the stem press. The arc tube attached to the support is then inserted into the bulbous portion of the outer envelope, and the separated portions are aligned with each other with their severed edges abutted. The abutted edges are then heated locally to the working temperature of the glass to fuse the previously separated portions in a gas-tight manner.

In a preferred method, the rigid support comprises a pair of rigid current-supply conductors extending from the stem press. For supporting the arc tube at the preferred angle, a metallic frame is provided for holding the tube. The arc tube can then be attached to and aligned with the frame independently of the stem assembly. This simplifies positioning of the arc tube in the outer envelope because only the frame and the stem support have to be aligned with each other when the frame is fixed to the current-supply conductors of the stem assembly. A preferred method is to weld the frame to the current-supply conductors.

To improve the support of the arc tube, the outer envelope may be provided with a discontinuity in the end opposite the neck portion, such as an inwardly extending dimple or an outwardly extending protrusion forming an inner cavity. The frame is then provided with an end section which engages the discontinuity for further securing the discharge vessel.

It is preferred if the step of severing the envelope is accomplished by scoring the exterior surface of the outer envelope around its circumference while rotating the envelope, heating the envelope along the scored line, and rapidly cooling the envelope until it fractures along the scored line. This leaves a pair of complementary edges on the separated portions of the envelope which are clean and not jagged. The term "scoring" as used hereinafter, means cutting the outer surface of the envelope to a depth less than the envelope thickness such that the envelope fractures along the scored line upon heating and rapid cooling.

The severing of a standard bulged tube envelope has the advantage that the resulting complementary edges make it easier to reseal the severed portions together, as opposed to sealing two separately molded envelope portions together. Additionally, since bulged tube envelopes are commercially available the lamp may be more cheaply manufactured than if the outer envelope had to be constructed from specially manufactured molded envelope portions.

For heating the butted edges to reseal the bulbous and neck portions, it is advantageous if a heat source is positioned adjacent the butted edges and rotated about the envelope to ensure even heating of the edges.

It is also preferable if the outer envelope, after resealing the two portions, is annealed in the area of the sealed edges to reduce stress in the envelope and avoid possible cracking.

DESCRIPTION OF THE PREFERRED EMBODIMENT

Figure 1A:
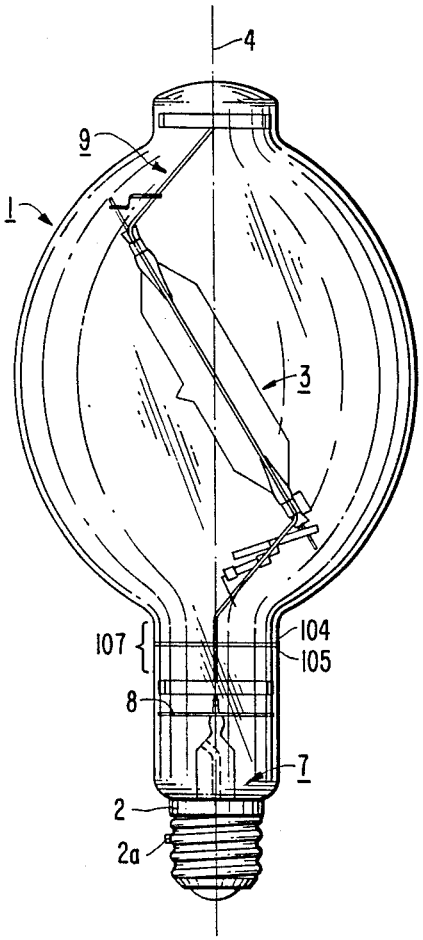
FIG. 1*a* is a side view of a metal halide lamp according to the invention, after installation of the lamp cap.
Figure 1B:
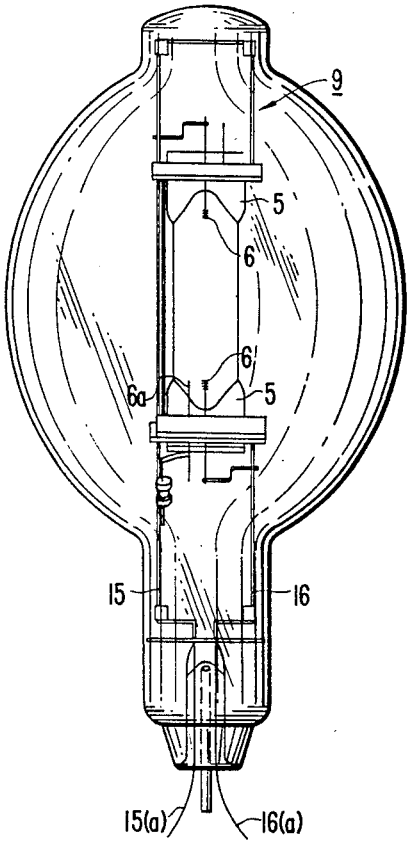
FIG. 1*b* is a side view of the lamp shown in FIG. 1*a*, rotated 90 degrees, before installation of the lamp cap.

FIGS. 1*a* and 1*b* show a metal halide lamp having a glass outer envelope 1 in which a metal halide arc tube 3 is mounted. The arc tube 3 is disposed at a predetermined angle with respect to the lamp axis 4. Stem press 7 seals the outer envelope in a gas-tight manner and supports frame 9 and heat shield 8. Frame 9 holds serves as a support for holding the discharge device 3 at the preferred angle with respect to the lamp axis 4 and also provides electrical connection to the arc tube 3.

The arc tube 3 is a tubular quartz arc tube having pinch seals 5 at opposite ends sealing the arc tube in a gas-tight manner. Discharge electrodes 6 and a starting electrode 6*a* pass through the pinch seals 5 and are connected to respective parts 15, 16 of the frame 9, which serve as current conductors. Conductors 15, 16 are connected to lead wires 15*a*, 16*a* which extend from the stem press 7 and are connected to respective portions of the lamp cap 2 for energizing the arc tube 3.

Figure 2:
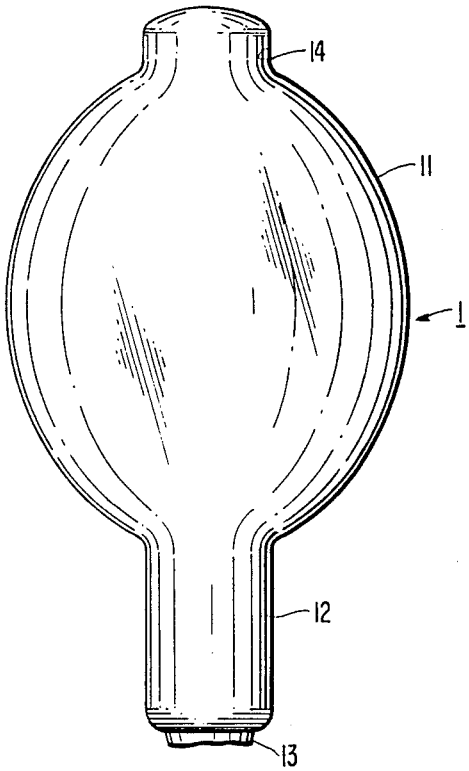
FIG. 2 is a side view of an outer envelope of the lamp of FIG. 1*b*.

As a first step in manufacturing the lamp, a standard bulged tube outer envelope 1 is provided, having a bulbous portion 11 and an adjoining neck portion 12 with an open end 13, as shown in FIG. 2. A protruding portion of the envelope opposite the neck portion defines a cavity in the interior surface of the lamp envelope which functions as a discontinuity for positioning one end of the frame 9.

Preferably the envelope 1 is a standard size and shape, such as a bulged tube (BT) envelope, usually used for HID lamps having the arc tube coaxial with the envelope. This permits a lamp having a canted arc tube to be manufactured from readily available commercial envelopes.

Figure 3A:
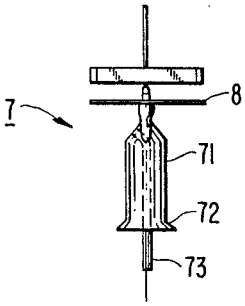
FIGS. 3*a* and 3*b* are side views of a stem assembly for the lamp of FIG. 1*b*.
Figure 3B:
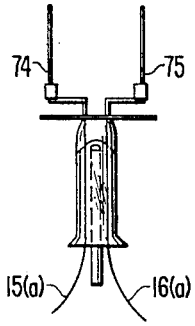

A stem assembly 7, as shown in FIG. 3*a* and 3*b*, is provided having a stem press 71 with a flared skirt 72 for sealing to the open end 13 of the neck portion. An exhaust tube 73 for evacuating the outer envelope extends through the stem press 72. A pair of current-supply wires 15*a*, 16*a*, suitable for connection to respective portions of the lamp cap, extend through the stem press. Rigid conductors 74, 75 for supporting the discharge vessel extend from the stem press, and are each connected to a respective current-supply wire 15*a*, 16*a* for energizing the arc tube.

Figure 4:
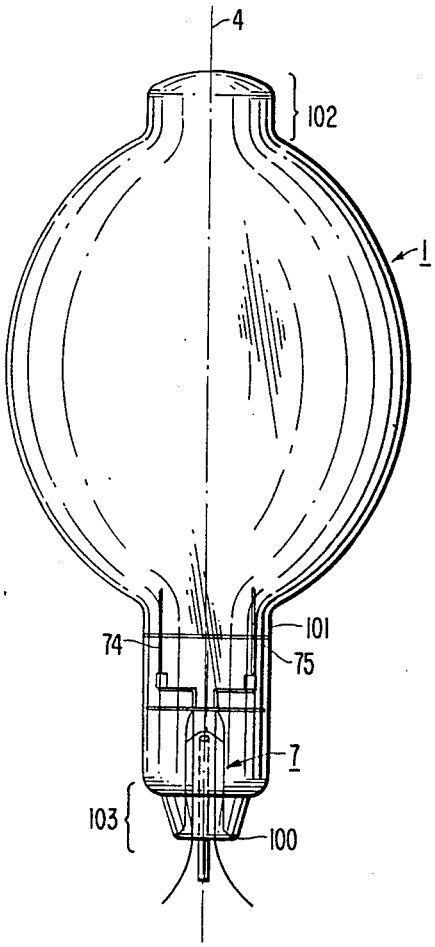
FIG. 4 shows the stem assembly sealed in the outer envelope of FIG. 2.

The stem assembly 7 is inserted into the neck portion 12 with the flared skirt 72 held against the open end 13, and then sealed to the neck portion of the outer envelope, as shown in FIG. 4. Both the flared skirt and the neck portion are heated in the region 10° to the working temperature of the glass for fusing the stem assembly to the neck portion and sealing the outer envelope in a gas-tight manner.

The bulbous portion 11 of the envelope is then separated from the portion of the envelope to which the stem assembly has been sealed. The envelope may be severed at any axial position which will allow the arc tube and frame to be mechanically and electrically secured to the rigid conductors 74, 75. In the preferred embodiment, the envelope is severed in the region 101 where the bulb portion merges into the neck portion. This not only permits the easiest access to the conductors 74, 75, but also prevents any adverse affects to the optical qualities or aesthetic appearance of the bulbous portion of the outer envelope.

Figure 5:
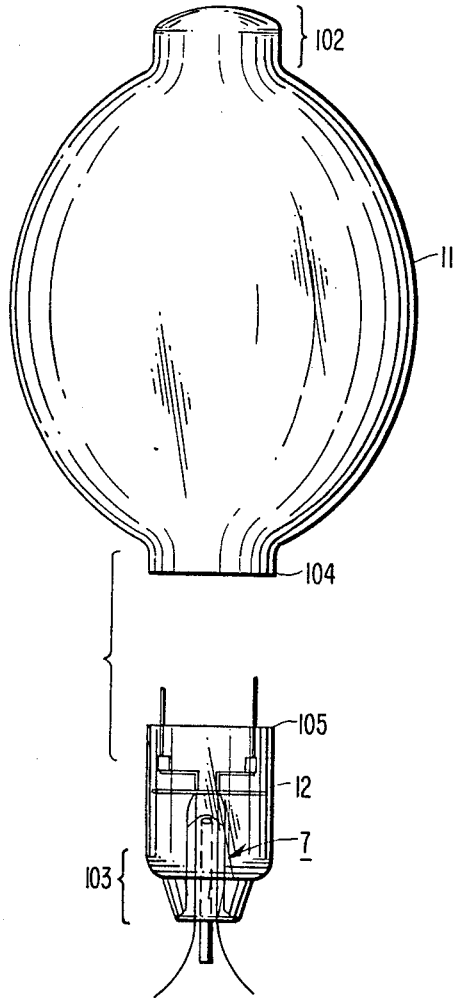
FIG. 5 shows the neck portion of the outer envelope severed from the bulbous portion of the outer envelope.

The preferred method of severing the bulb is to first score the lamp envelope around its circumference to a predetermined depth. Then, using a sharply defined flame, the envelope is heated along the scored line. To separate the two envelope portions, the envelope is rapidly cooled which causes the envelope to fracture along the scored line. This leaves two complementary edges 104, 105 which are smooth and not jagged. Scoring and heating of the envelope can be rapidly accomplished by gripping the outer envelope at areas 102, 103 and rotating the bulb about the lamp axis 4. (FIG. 5)

Figure 6A:
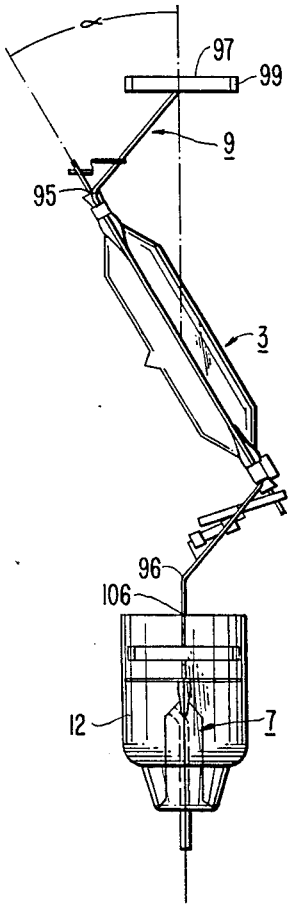
FIG. 6*a* is a side view of the arc tube fixed to the neck portion and frame of FIG. 5.
Figure 6B:
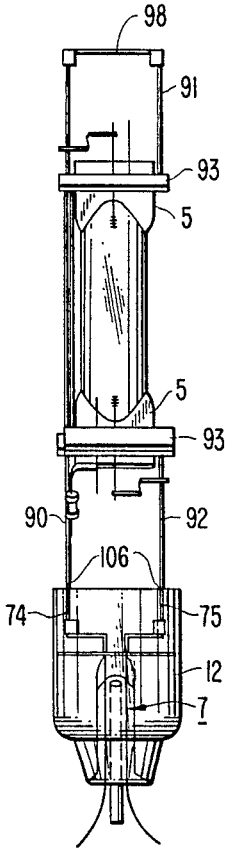
FIG. 6*b* is a view of the structure of FIG. 6*a* rotated 90 degrees.

The frame 9 for holding the arc tube 3 is shown clearly in FIGS. 6*a* and 6*b*. The frame has a bent wire leg 90 extending the length of the arc tube and having two opposite bends 95, 96 for supporting the arc tube at the preferred angle $\alpha$ within the outer envelope. Metallic bands 93 each grasp a respective pinch seal 5 for securing the arc tube 3 to the rigid leg 90. Legs 91, 92 are also grasped by a respective band 93. Upper leg 91 is secured to leg 90 by a cross brace 98 for improving the rigidity of the frame. The top portion of the frame is also provided with resilient arms 97 attached to legs 90, 91. The bands 97 have an elbow portion 99 near each end which contact the inner wall of protruding portion 14 of the outer envelope for securing the top portion of the frame.

As shown in FIGS. 6*a* and 6*b*, the frame 9 carrying the arc tube 3 is secured to the stem assembly 7. A preferred method is to weld each of the legs 90, 92 to a respective current-supply conductor 74, 75 at location 106. The conductors 74, 75 may be trimmed to a desired length prior to securing of the frame.

Figure 7:
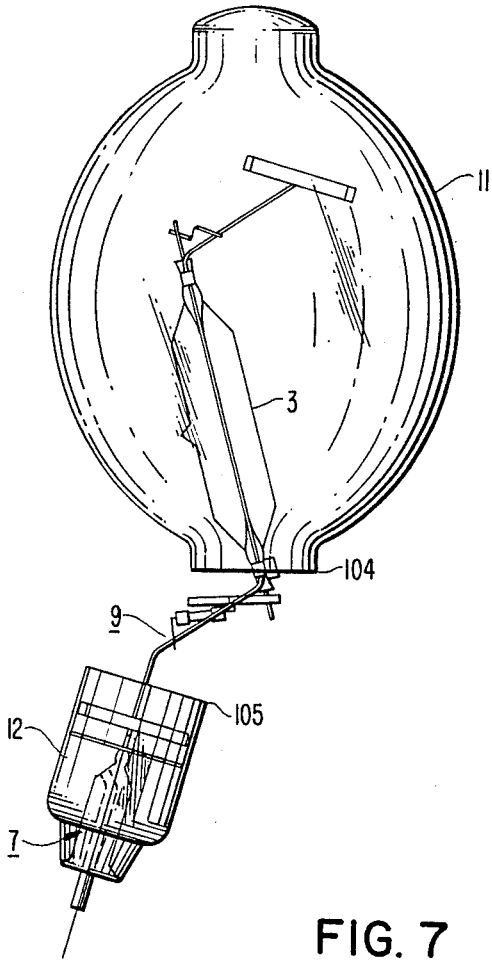
FIG. 7 shows the arc tube being maneuvered into the bulb portion of the outer envelope.

The subassembly of the discharge device 3, frame 9, stem assembly 7, and neck portion 12 are then assembled with the bulbous portion 11 of the outer envelope. The arc tube 3 is first maneuvered into the bulbous portion and the top portion of frame 9 is guided into the protruding portion 14 as shown in FIG. 7. Then the neck portion 12 is aligned with the bulb portion 11 so that the severed edges 104, 105 butt against each other as shown in FIG. 1.

The lower assembly is then sealed to the bulbous portion by heating the envelope in the region of the abutting edges to the working temperature of the glass until the portions are sealed in a gas-tight manner. A preferred method of fusing the edges is to hold the bulb and neck portions against each other, direct a gas flame or flames at the butted edges, and rotate the flames around the circumference of the envelope to evenly heat the abutted edges. It is preferable to rotate the flames around the envelope portion and to keep the envelope portions rotationally stationary so that the two portions may more easily be kept in alignment.

The bulb portions are preferably held in a sealing fixture which automatically sets the length of the envelope by drawing the two envelope portions away from each other or pushing the two envelope portions towards each other while the glass in the area of the abutted edges is still workable. Such sealing fixtures are commercially available.

After the envelope has cooled, the envelope may be annealed at the area of the joint to reduce the stress in that area.

The lamp is then completed by providing a lamp cap, such as a mogul base 2, connecting each current-supply wire 15*a*, 16*a* to a respective portion of the base, and cementing the lamp base to the end of the neck portion. The lamp cap may have indexing means for ensuring that the canted arc tube is correctly positioned in the luminaire and oriented with respect to the surface to be illuminated. A proposed solution is to fix an indexing pin 2*a* to the mogul base radially extending from a crest of a thread at a predetermined location. The socket for receiving the mogul base would have a stop which would allow the lamp to be screwed into the socket only a predetermined number of turns so that the arc tube is correctly positioned with respect to the socket.

Those of ordinary skill in the art will appreciate that many variations of the inventive method are possible. For example, rather than insert a remote end of the frame 9 into a protruding portion 14, the frame end may include a loop or cup for engaging a dimple protruding into the envelope.

Additionally, if it were desired to manufacture a lamp having an arc tube aligned with the lamp axis in which the arc tube and support frame were wider than the neck portion, the outer envelope could be severed at the region of the bulbous portion which is wide enough for the arc tube and support frame to be inserted through.

What is claimed is:

1. A method of manufacturing a high intensity discharge lamp having a glass outer envelope with a bulbous portion defining the largest diameter of said envelope and an elongate neck portion extending from said bulbous portion, and a discharge vessel and support frame which are not insertable through said neck portion during lamp assembly, said method comprising the sequential steps of:

(a) providing said glass outer envelope, said neck portion terminating at an open end, and a stem assembly for insertion in said neck portion for closing said open end, said stem assembly comprising a stem press for sealing to said open end of said neck portion and a rigid support fixed to said stem press;

(b) sealing said stem assembly in said open end of said neck portion for closing said open end;

(c) severing said outer envelope along the circumference in an axial region spaced from said largest diameter and separating the base end portion having said neck portion from the remote portion not having said neck portion, said severing defining complementary severed edges on the severed portions;

(d) securing said discharge vessel to said rigid support at a predetermined orientation to said lamp axis defined by said neck portion;

(e) maneuvering said discharge vessel into said remote envelope portion;

(f) aligning said base end portion with said remote envelope portion and butting said complementary edges against each other; and (g) sealing the envelope portions to each other in a gas-tight manner at said complementary edges.

2. A method as claimed in claim 1, wherein said envelope portions are sealed to each other by heating the abutting edges to the working temperature of said glass for fusing said abutting edges.

3. A method as claimed in 2, wherein for heating said abutting edges of said envelope portions, a heat source is positioned opposite said abutting edges and rotated about said envelope portions for evenly heating said abutting edges.

4. A method as claimed in claim 3, wherein said outer envelope is severed by circumferentially cutting said neck portion where said neck portion merges into said bulb portion.

5. A method as claimed in claim 1, wherein said outer envelope is severed by circumferentially scoring the exterior surface of said outer envelope, heating the outer envelope in a narrow region bounding the resulting scored line, and rapidly cooling the heated narrow region to circumferentially fracture the envelope along the scored line.

6. A method of manufacturing a discharge lamp having an arc tube canted with respect to the lamp axis, said method comprising:

(a) providing a glass outer lamp envelope, said outer envelope having a bulbous portion defining a largest diameter of said envelope and surrounding said arc tube, and an elongate neck portion extending from said bulbous portion terminating at an open end, said neck portion defining a lamp axis;

(b) providing a stem assembly for insertion in said neck portion for closing said open end, said stem assembly comprising a stem press having a flared skirt for sealing to said open end of said neck portion, and a pair of rigid current-supply conductors extending from said stem press;

(c) sealing said stem assembly in said open end of said neck portion for closing said open end;

(d) severing said neck portion near said bulbous portion and removing said neck portion and stem assembly from said bulbous portion, said severing defining complementary edges on said neck and bulbous portions;

(e) providing an arc tube;

(f) securing said arc tube to said rigid current-supply conductors at a predetermined angle to said stem and electrically connecting said arc tube to said current-supply conductors;

(g) inserting said arc tube into said bulbous portion of said outer envelope;

(h) aligning said neck portion with said bulbous portion and butting said complementary edges against each other; and (i) sealing said neck portion to said bulbous portion at said complimentary edges.

7. A method as claimed in claim 6, wherein said outer envelope is severed by circumferentially scoring the exterior surface of said outer envelope, heating the outer envelope in a narrow region bounding the resulting scored line, and rapidly cooling the heated narrow region to circumferentially fracture the envelope along the scored line.

8. A method as claimed in claim 6, wherein said envelope portions are sealed to each other by heating the abutting edges of said neck and bulbous portions to the working temperature of said glass for fusing said abutting edges.

9. A method as claimed in 8, wherein for heating said abutting edges of said neck and bulbous portions, a heat source is positioned opposite said abutting edges and rotated about said envelope for evenly heating said abutting edges.

10. A method as claimed in claim 6, wherein said outer envelope has a discontinuity opposite said neck portion, and said method further comprises providing a support having a first end for connection with the remote end of said arc tube opposite said current-supply conductors and with a second end for cooperating with said discontinuity for supporting said arc tube, securing said first end of said support to said remote end of said arc tube, and mating said second end of said support with said discontinuity when said arc tube is inserted into said bulb portion of said outer envelope.

11. A method as claimed in claim 10, wherein said discontinuity is an exterior protrusion in said envelope in the region opposite said neck portion which defines a cavity in the interior of said outer envelope, said second end of said support is shaped for insertion into said cavity, and said support second end being inserted into said cavity when said arc tube is inserted in said bulb portion.

12. A method as claimed in claim 6, wherein said step of securing said arc tube to said rigid current-supply conductor comprises providing a frame for holding said arc tube, securing said arc tube to said frame, and securing said frame to said rigid conductors with said arc tube at said predetermined angle with respect to said lamp axis.

* * * * *